US006018566A

United States Patent [19]

Eberhard et al.

[11] Patent Number: 6,018,566

[45] Date of Patent: Jan. 25, 2000

[54] GRID FORMED WITH SILICON SUBSTRATE

[75] Inventors: Carol D. Eberhard, Rolling Hills Estates; George G. Pinneo, Manhattan Beach; Moshe Sergant, Culver City, all of Calif.

[73] Assignee: TRW Inc., Redondo Beach, Calif.

[21] Appl. No.: 08/957,541

[22] Filed: Oct. 24, 1997

[51] Int. Cl.[7] ..... G21K 1/00

[52] U.S. Cl. ..... 378/154; 378/145

[58] Field of Search ..... 378/154, 155, 378/145

[56] References Cited

U.S. PATENT DOCUMENTS

| | | | |
|---|---|---|---|
| 2,605,427 | 7/1952 | Delhumeau | 250/63 |
| 4,158,141 | 6/1979 | Selliger | 250/492 |
| 5,416,821 | 5/1995 | Frazier et al. | 378/154 |
| 5,418,833 | 5/1995 | Logan | 378/154 |

*Primary Examiner*—Craig E. Church

*Attorney, Agent, or Firm*—Michael S. Yatsko; Ronald M. Goldman

[57] ABSTRACT

An X-ray collimator grid is formed within a wafer of monocrystalline silicon material by forming a plurality of spaced parallel elongate slots within a planar surface of a silicon crystal wafer, and forming slats of heavy metal in situs within each of said slots, including squeegeeing the heavy metal into the slots, from particles of heavy metal, each said slat gripping the walls of an associated slot.

12 Claims, 2 Drawing Sheets

GRID FORMED WITH SILICON SUBSTRATE

FIELD OF THE INVENTION

This invention relates to X-ray collimator grids, and, more particularly, to a method of fabricating a collimator grid containing a silicon crystal mono-crystalline substrate and to a mono-crystalline silicon X-ray collimator grid formed thereby.

BACKGROUND

X-ray collimator grids assist one to obtain a clear image of a distant X-ray source. The x-rays travel toward the X-ray detector in a straight line. X-rays propagating from the source pass through the collimator tube and grids while X-rays arriving from other directions which would degrade the desired image are blocked. The collimator grid allows parallel X-rays traveling in parallel to the collimator to pass through to an X-ray target upon which the X-ray image is formed. The arrangement is somewhat analogous to the light sorting accomplished by ordinary "Venetian" blinds, such as found in one's household windows. Formed of spaced, flat, parallel light impervious slats, the Venetian blinds sorts light rays. When the slats in the blinds are oriented perpendicular to the glass window, the image enters from the front and passes through. However, stray light arriving from directions higher up or lower down is blocked by the slats.

One prior collimator arrangement for sorting X-rays is disclosed in a prior U.S. patent to Delhumeau, U.S. Pat. No. 2,605,427 granted Jul. 29, 1952, presenting a grid device for preventing diffusion of X-rays from a nearby X-ray source. Delhumeau mounts slats of heavy metal, such as Lead, a material that is impermeable to X-radiation, within slots or grooves, however termed, formed in a resin support structure, a material permeable to X-radiation, spacing the slats about 0.4 mm apart. The grooves are about 1.5 mm deep and about 0.1 mm wide.

Because of the close proximity of the X-ray source in Delhumeau's system, the rays from the source travel in a path defining a right circular cone toward Delhumeau's focusing device and, accordingly, the metal slats are oriented, not in parallel, but at progressively smaller angles relative to the face of his device in dependence upon the distance of the slat from the axis of the X-ray source. Delhumeau's grid thus "focalizes" the oncoming X-radiation, unlike the present invention, which collimates the X-radiation.

The Delhumeau patent also hypothesizes alternative forms for the heavy metal, suggesting disposition of a metal powder in the grooves, or, with modification of the frame, an absorbent liquid, such as Mercury, but offers few details for implementation. For a Silver amalgam, Delhumeau notes that the amalgam hardens over time. Notwithstanding those hypotheticals, one recognizes that the anti-diffusion grid structure of Delhumeau is perhaps intended for medical or industrial application having close by X-ray sources and not for unattended use in exploration in outer space.

In a prior patent to Frazier et al, U.S. Pat. No. 5,416,821, granted May 16, 1995 and assigned to TRW Inc., the assignee of the present invention, a novel X-ray collimator grid is described that is useful even in unattended space exploration. Frazier found that a monocrystalline silicon wafer affords a robust and effective collimator support structure that withstands the rigors of the low temperature vacuum regions of outer space as well as the transition from earth atmosphere to that environment and back. Frazier's grid contains an array of spaced parallel heavy metal (high "Z") slats, impervious to X-radiation, that are mounted upon a silicon crystal substrate or, as variously termed, wafer, an X-ray permeable material. Suitable heavy metals are those having an atomic weight equal to or greater than the atomic weight of Hafnium, where Z equals 72, such as Tungsten of a Z equal to 74. The slats in that structure are oriented in parallel with the <111> crystal plane.

To fabricate Frazier's collimator structure, the silicon crystal slab is etched to create a number of voids or apertures within a central region of the wafer that extend through the crystal wafer. Those apertures are separated by retained portions of the silicon crystal and define ribs or straight frame sections that extend across that central region. Grooves, trenches or slots, as variously termed, of microscopic sized widths, typically in the range of fifteen microns through one-hundred microns in width, are etched into the silicon crystal wafer oriented in parallel with the <111> crystal plane and seat the heavy metal slats.

The foregoing construction produced a majority of linear slots that are discontinuous due to the intervening apertures, extending in a linear path across the remaining portions of the silicon slab, including the laterally extending silicon ribs bounding the apertures. Straight flat slats formed of a heavy metal, Tungsten, as example, were then picked up and manually inserted within the respective trenches or slots as could be accomplished with vacuum tweezers. The apertures through the silicon wafer provided clearance space for handling and inserting the metal slats, although being located in the path of the slots created the physical discontinuity or gaps in the slot's linear extent. The monocrystalline silicon wafer was oriented so that the face of the crystal was in the <1,1,0> crystallographic plane to permit proper etching of deep narrow slots. For additional details of fabrication and application of that collimator grid and as additional background, the reader is invited to refer to and review the Frazier et al patent.

In practice, the Frazier et al structure proved difficult to manufacture. It was found that Tungsten, though strong and stiff, was difficult to form into the microscopically thin strips or foils having the requisite flatness, and the foils surface was uneven. Because of the Tungsten slat's essentially rippled surface, the slats would not easily fit into the slots, making assembly difficult. When forced into the slot, a slat often would damage the side walls of the slot and the slot thereafter could no longer reliably support the respective slat. As a consequence, the yield of collimators was prospectively low, and the manufacturing expense anticipated was higher than desired.

Lead, which oxidizes, had other difficulties that were thought to make that material undesirable for slats in the X-ray collimator application. Because of the difficulties with the foregoing metals, resort was made to another heavy metal for the slats, Gold. The gold does not corrode and is much softer than Tungsten or Lead, which makes it desirable, but, it is more expensive than the latter materials.

Although Gold could be produced in straight flat strips at the fifteen micron thickness level, the strips did not have sufficient rigidity. In effect, in the elongated form of a microscopically thin slat, the Gold was found too soft and limp. Thus Gold slats also proved difficult to mechanically insert in a straight line in the discontinuous sections of a microscopic slot or trench formed in the silicon wafer structure described in the Frazier et al patent. It is apparent, thus, that the process described by Frazier et al produced collimator grids that would have a higher than desired production cost. As an advantage, the present method invention does not require the laborious mechanical insertion of straight slats into microscopic slots.

Accordingly, an object of the present invention is to provide a new and more easily accomplished method of fabricating high Z metal slats within a silicon substrate X-ray collimator grid that avoids the requirement for preforming straight slats of heavy metals and avoids the step of mechanically inserting slats of heavy metal within slots formed in the surface of the silicon crystal substrate.

And an ancillary object of the invention is to provide a new rugged X-ray collimator grid structure, fabricated by the new method.

SUMMARY OF THE INVENTION

In accordance with the foregoing objects and advantages, and characteristic of the new method, a plurality of microscopically narrow spaced elongate slots are formed, without discontinuities or "open areas", in the planar <110> surface of a silicon crystal wafer, with the slots depending into the crystal to a predetermined depth; and a slat of predominantly heavy ("high-Z") metal is formed in situs within each of the slots from particles or granules of heavy metal material that are collected within the slots, and is firmly secured in the slot. Within the foregoing context, a heavy metal is understood to be a metal element or a metal alloy, a metal product containing one or more elements, at least one of which is a metal, (1) as a solid solution, (2) as an inter-metallic compound, or (3) as a mixture of metallic phases. The slats are spaced apart in parallel and are no greater in width than the width of the slot and no greater in height than the slot depth and extends the length of the slot.

The formed trenches or slots are continuous. Accordingly, the support of the slats within the crystal wafer is significantly improved and a more rugged grid construction is obtained.

In accordance with one specific embodiment of the method, in-site slat formation is accomplished by preparing a paste of heavy metal particles, small enough in size to fit within the microscopically narrow slot, mixed with a curable binder; placing a portion of that paste within the slots, preferably by spreading the paste about the surface and squeegeeing the paste into the slots; and then curing the binder. The squeegeeing employs hydraulic pressure to force paste into the slots, forcing air out. In a variation of the foregoing process, a degassing step may be employed, prior to curing, to pull entrained air out of the bonding material. The foregoing step of placing and curing the paste is repeated a number of times as necessary until the slot is filled to the desired level and the layers of metal paste are solidified or hardened into unitary masses defining slats.

In accordance with a more specific aspect to the invention the preferred metal is Gold (Au) and the binder may comprise an epoxy, polyurethane, or other thermosettable bonding agent. Although the latter materials, typically, are pervious to X-radiation, the predominant material of the slat is Gold and is sufficient to render the slat impervious to x-radiation.

The viscosity of a heat curable epoxy binder drops as the temperature increases during curing and the heated paste flows under the influence of gravity into the available space at the lowermost available space within the slot, displacing air and filling microscopic crevices in the slot walls. As the temperature increases further during curing, the rapid onset of cross-linking of the epoxy occurs, ie. reactive polymerization, producing a solid gold filled material that at a minimum mechanically links or bonds to the slot walls.

The slats formed in the foregoing manner are straight and solid and are firmly fixed in place in the substrate. They contain a high percentage of heavy metal, the remainder being the bonding agent. It is found that the percentage of heavy metal in the formed member is high enough so that the slat possesses an X-ray blocking characteristic that is almost as effective as a slat formed entirely of the heavy metal.

In accordance with an alternative embodiment for in-situs slat formation, microscopic sized heavy metal particles are deposited within the slots, also suitably by squeegeeing, and are heated to fuse the particles together and form at least a mechanical bond to the slot walls. In a practical embodiment thereof, the particles comprise a metal alloy of 96.4% Gold and 3.6% Silicon (Si) (by weight), which has a melting point of 371 degrees Centigrade; another alternative embodiment of a metal alloy of 88% Gold and 12% Germanium (Ge)(by weight), which has a melting point of 356 degrees centigrade; and still another alternative embodiment of Gold.

Still another specific embodiment employs a 80/20 alloy of gold and tin (Sn), a well known solder composition. For the in-situs slat formation, the gold/tin alloy particles are deposited in the slots, and a solder flux is applied thereover. The entire wafer subassembly, including the gold tin particles are heated to their eutectic temperature and the particles liquify. The heat is thereafter withdrawn and the liquid metal alloy then re-solidifies into a metal bar, which forms the slat.

As an advantage, the in-site slat formation provides an improved attachment or bond between the slats and the silicon substrate. The reduced viscosity effect or liquification of the metal matrix that occurs during the curing process allows the metal matrix to fill minute irregularities in the walls of the slots. Because of that intermixture, upon solidification, the slat is difficult to withdraw due to mechanical restraint, friction, produced by engagement with those surface irregularities.

The foregoing and additional objects and advantages of the new method together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DESCRIPTION OF THE PREFERRED EMBODIMENTS

As an improvement, the fabrication process of the present invention incorporates as a component element a silicon wafer that contains spaced parallel slots that lie in parallel the <111> crystal plane. Those slots are formed to a predetermined width and depth and are present in a predetermined number. By itself etching of slots in silicon crystal wafers is not new. In practicing the invention as hereafter described, that component may be obtained sometimes from vendors who possess special capability in the fabrication and working of crystal wafers. Such vendors may utilize proprietary techniques to process and work the silicon wafer, the details of which are not necessary to an understanding of the present invention. Some such vendors may include other departments of the assignee of the present invention. Accordingly, some of the preliminary steps presented and examples given in obtaining the slotted silicon crystal wafer are known to the prior art and, while not absolutely necessary to an understanding of the present improvement invention, those details are included to ensure completeness of the disclosure of the present invention.

Figure 1:
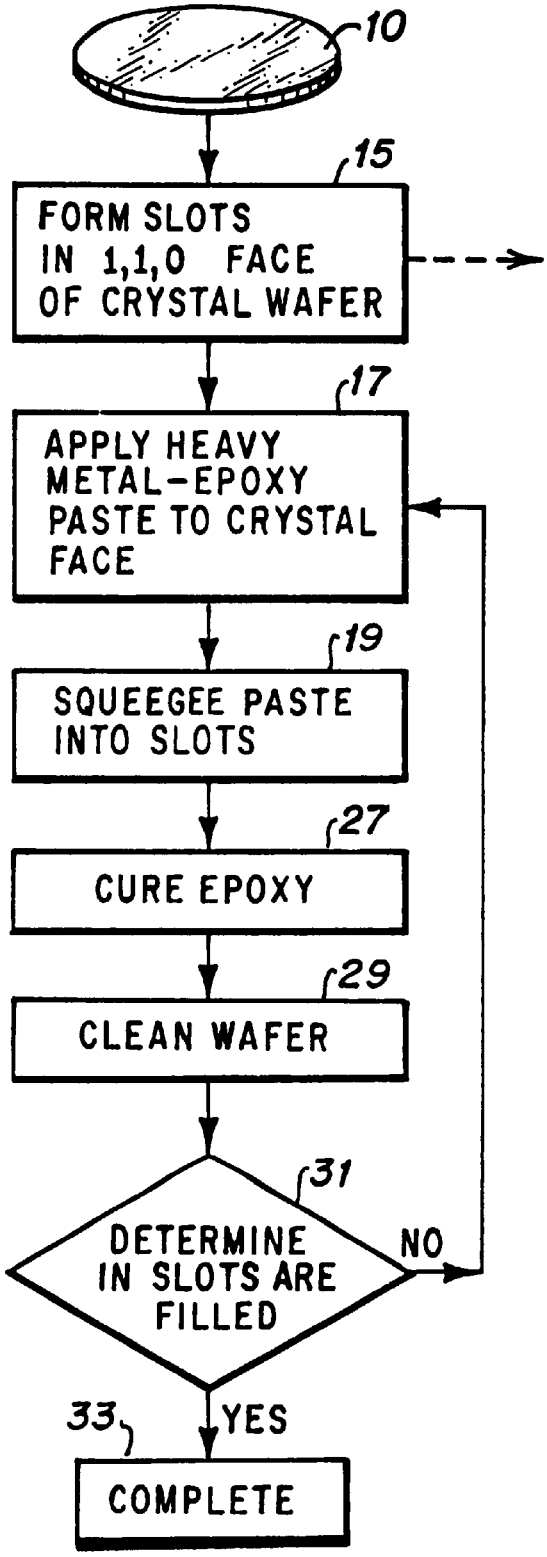
FIG. 1 illustrates the steps of an embodiment of the new method.

Reference is made to FIG. 1 illustrating an embodiment of the new grid fabrication process. As illustrated, a thick blank 10 is sliced from a grown single silicon crystal ingot from a standard cylindrical silicon boule. The silicon crystal blank is cut and lapped to obtain substrate surfaces or faces, as variously termed, that lie in the <110> plane, and that substrate is polished to assure the surface is free of defects. As illustrated by block 15, spaced parallel slots of microscopic width are formed across the face of the wafer 10 in parallel with the <111> crystal plane and that is accomplished by micro-machining with an etchant.

There are several methods by which the orientation of the <111> plane may be determined. Usually, one may obtain the wafer from a vendor with the <111> direction already marked by the vendor, as example, a flat edge of the wafer aligned in the correct direction or by a line marked on the wafer. To determine the correct direction in that instance, one merely looks for the specified flat or marked line. If one is unable to have the vendor perform that service or otherwise finds need to do so in ones factory, then one may locate the correct direction on the wafer using the conventional "fan" technique, which is the same technique employed by such wafer vendors.

Figure 2:
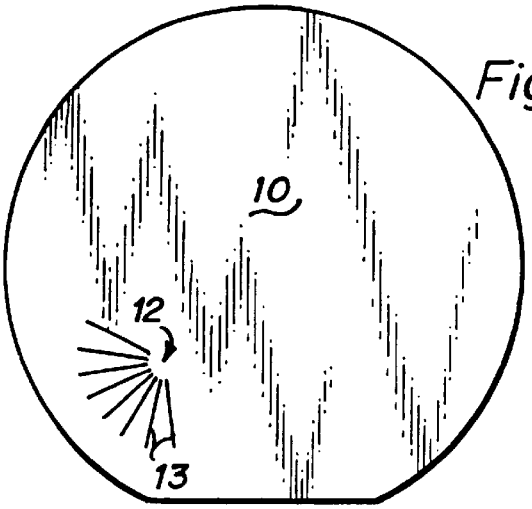
FIG. 2 pictorially partially illustrates the wafer surface in an intermediate stage when ascertaining the slot direction as needed for the method of FIG. 1.

For completeness, that technique is further described. As pictorially illustrated in FIG. 2 to which brief reference is made, to locate the orientation of the <111> plane on the surface of wafer 10, an alignment pattern 12 consisting of a fan pattern of short straight "orientation" lines 13 is etched into the <110> surface of the wafer 10 to reveal the exact orientation of the <111> plane. Lines 13 in the <110> planar face of silicon crystal wafer 10 originate at a common location, the center, and extend radially outward from that center a short distance, each line extending in a different angular direction, and overall resembles a "fan" in appearance.

To etch the fan of orientation lines into crystal, a $Si_3N_4$ chemical vapor deposition ("CVD") coating is deposited on both sides of the silicon wafer 10. Spin-on standard positive photo-resist, AZ1350 (Hoechst Celanese, Summerville, N.J.) at 5000 rpm as a deposit. After spin-on, the blank is soft baked at 90 degrees Centigrade to drive off solvents in the photo-resist. The photo-resist covered by the fan mask is exposed to ultraviolet light.

The photo-resist is developed by immersion in a potassium hydroxide (KOH) solution in a beaker. After a hard bake at 125 degrees Centigrade, the silicon wafer is subjected to standard plasma etching of the Si3N4. This is followed by stripping of the residual photo-resist in acetone. The orientation grooves can now be etched by immersion in a standard KOH etch solution for about an hour. This etches the orientation lines to a depth of about 50 micrometers.

The lines etched into the crystal are inspected to determine which one is the straightest and most sharply defined, as occurs because that one line is properly oriented in parallel with the <111> crystal plane. That selected orientation line determines the direction of the slots to be formed in the succeeding steps. The remaining lines in the fan pattern appear jagged. The selected line establishes the direction for all slots subsequently etched into the surface of the wafer.

The atoms in a silicon lattice are arranged in a face-centered cubic structure as further defined in "Physics of Semiconductor Devices" by S. M. Sze, Wiley-Interscience, N.Y., pages 12–17. When the crystal lattice is oriented along the <110> plane, a hexahedral column of space is defined by the silicon atoms and their associated interatomic bonds. That column of space extends orthogonal to the <110> plane, that is, perpendicular to the surface of the silicon crystal wafer. That pattern of columns is repeated throughout the crystal. The <110> orientation provides the maximum space between atoms in the crystal lattice. A pictorial illustration of the the atoms in that orientation is presented in U.S. Pat. No. 4,158,141, granted June 12, 1979 to Selliger et al, who takes advantage of that maximum space for channeling ion beams in ion beam lithography apparatus.

As noted in the Frazier et al patent, etching the silicon along those hexahedral columns to form the slots in the crystal is accomplished at an etching rate more than 100 times greater than the etching rate for the traverse direction, and allows very deep narrow high definition slots to be etched into the crystal.

Continuing with FIG. 1, the slots are next formed in the face of the crystal, which is also accomplished by masking and etching using the basic procedure as before. It is noted that typically the alignment mask is obtained from outside vendors. Typically a tape of the pattern of straight narrow slots 20 is generated on a CAD system. That tape is typically sent to the "mask house" that specializes in the conversion of the CAD tapes and production of alignment masks, who delivers the prescribed alignment mask.

The crystal wafer is cleaned; $Si_3N_4$ CVD coating is deposited on the wafer surfaces, suitably to a thickness of 2,500 Angstroms, using plasma enhanced CVD deposition to minimize stress problems in the coating; and photo-resist is deposited on the wafer surfaces and soft baked.

With the slot direction established as described, the alignment mask containing the multiplicity of straight narrow parallel lines is aligned on the wafer and applied to the wafer surface, the mask's lines running in the same direction as the described selected orientation line obtained in step 11; and the alignment mask is exposed to ultraviolet light.

The photo-resist is then developed and the wafer is hard baked. A plasma etch etches the $Si_3N_4$ on the top surface. The wafer is then immersed in a 55% concentration of KOH etchant at a temperature of 85 degrees C. until the silicon is etched to the desired depth, which etches the silicon and forms the slots, producing slots that are about 1,170 to 1,200 microns ($10^{-6}$ m)deep and 13 microns wide at the bottom and 15 microns wide at the top, thereby forming slightly tapered side walls to the slot. Thereafter the $Si_3N_4$ is stripped and the wafer is again cleaned.

The substrate is now ready to receive the slat material. A Gold filled paste mixture, such as Ablebond® 8770 or 85–1 marketed by the Ablestik company, is suited for that purpose, or an appropriate mixture of Gold and a bonding agent, such as an epoxy or polyurethane, is formulated. With the latter, fine metallic gold powder formed of granules in a range of sizes that are less than 10 microns in diameter, as may be obtained from commercially available sources, is mixed in an epoxy to form a paste mixture that is at a minimum 40% to 50% gold by volume. The epoxy is formed of a resin and a hardener and is heat curable, that is, thermosetting.

Figure 3:
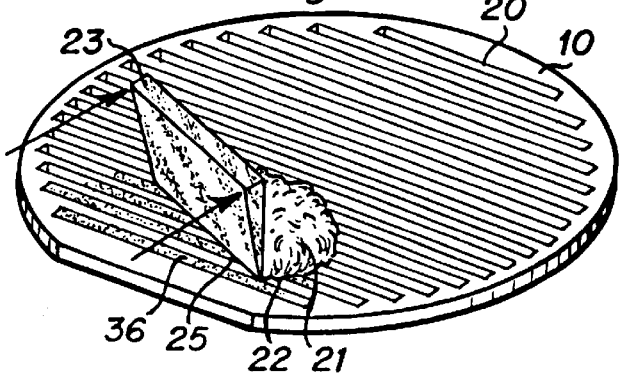
FIG. 3 pictorially illustrates in greater detail the step of placing the heavy metal particles in the formed slots used in the embodiment of FIG. 1.

Next, as represented at 17, a portion of the epoxy gold paste is placed on the surface of the wafer into which the slots were etched. As represented at 19, a squeegee is used to sweep or spread the paste about the surface, hydraulically forcing a portion of the mixture into the slots, a step that is referred to as squeegeeing. The latter step is pictorially illustrated in FIG. 3 to which brief reference is made. This illustration shows a deposit of epoxy-gold paste 21 disposed atop the crystal wafer 10 and a squeegee 23.

As illustrated, squeegee 23 contains a flexible rubber blade 25 having a straight edge. The squeegee is a kind of tool familiar to the lay person who may employ one to wash the household windows. Applying a slight downward pressure on the squeegee support causes the rubber edge to press against the flat surface of the crystal wafer. And while maintaining that slight downward pressure, the squeegee is drawn across the surface of the crystal wafer from behind the epoxy paste 21 wherein the edge of the rubber blade sweeps or spreads the paste along the surface and hydraulically forces some portion into slots 20, displacing air, which is forced out. The foregoing action is much like the squeegeeing used in the silk screening process for producing artist's posters.

Returning to block 19 in FIG. 1, the foregoing squeegeeing places some of the gold containing paste into the upper end of the formed slots. Optionally at this point in the process one may subject the treated crystal wafer to one or two short vacuum cycles of a conventional degassing procedure, as is widely practiced to pull entrained air out of two-component bonding materials, such as epoxies or polyurethanes. The epoxy is then cured by heating the wafer to the temperature at which the rapid onset of cross-linking, that is reactive polymerization, of the epoxy occurs as at 27. Then the surface of the wafer is cleaned to remove any excess paste on the wafer surface as at 29. If the surface of the wafer is left with random traces of Gold-epoxy or anything else, cleaning is accomplished by fine grinding the wafer surface to obtain the original flat surface, removing all deposits except those in the slots.

In heating, the epoxy's viscosity drops, and, under the force of gravity, the gold filled epoxy mixture sinks along the side walls of the slot to the slot bottom. The "fluid" like paste seeps into microscopic crevices in the slot's walls and partially fills the slot and allows trapped gas bubbles to escape. As curing continues, the gold particle filled epoxy hardens.

As a variation to the foregoing step, mechanical vibration and/or surface tension effects may be added to enhance the settling of the gold filled epoxy to the bottom of the slots.

No attempt is made to fill the slot completely in one cycle of filling and curing; multiple squeegeeing is preferred. Thus as represented at 31, a decisional determination is made as to whether the slots are filled. If not, steps 17, 19, 27, and 29 are repeated. Another portion of the epoxy gold paste is placed on the wafer as at 17, and that paste is squeegeed over the surface as at 19, adding a further portion of gold epoxy within the slots. The epoxy is again cured as at 27. During curing, the paste becomes less viscous and sinks along the side walls of the slot and onto the previously cured epoxy paste, further filling the slots. The surface of the wafer is again cleaned of any excess residue as at 29.

The foregoing squeegeeing procedure is repeated three or four times until the slots are filled to the desired level with cured gold filled epoxy and the process is determined to be complete as represented at 33, which completes the process.

In the foregoing manner, the X-radiation impenetrable slats are formed in situs within the slots and are rigidly secured in place, at least mechanically bonded to the silicon wafer. The Ablebond® 8370 or 85–1 gold filled epoxy, which is the preferred paste, may also actually chemically bond to the silicon slot walls to produce a stronger attachment. It is found that the percentage of gold in the slat is high enough in volume to retain the desired characteristic of blocking passage of X-radiation, even though not a solid pure metal.

The foregoing process avoids the tedious procedure of mechanically positioning microscopically narrow slats in microscopically narrow slots as required in Frazier et al. In as much as the slots are continuous, unlike the slots in Frazier et al, the resultant X-ray collimator is more rugged in structure, an added advantage.

While gold particles are used in the foregoing procedure, it is understood that like sized particles of other heavy metals, if available, like Platinum, Tungsten, Uranium and the like, can be substituted.

Figure 4:
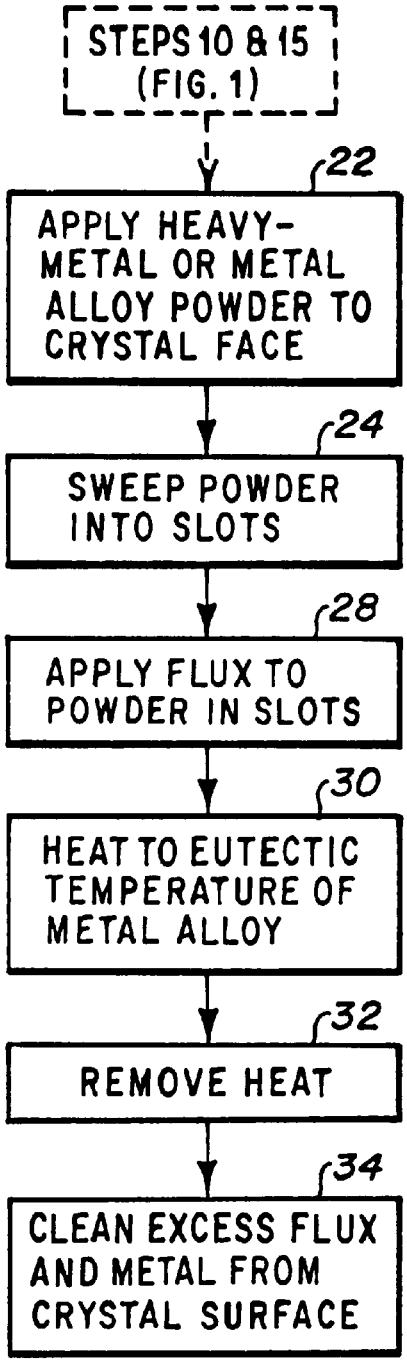
FIG. 4 illustrates an alternative embodiment of the new method.

Reference is made to FIG. 4, illustrating the steps of an alternative method of fabricating the X-ray collimator grid, that does not incorporate a binder, such as the described epoxy. This alternative method initially repeats the same steps 10, 11 and 15 of the process illustrated in FIG. 1, earlier described. The reader may review that portion of the previous described, since it is not here repeated. A heavy metal or metal solder is obtained in the form of a dry powder, containing granules of ten microns diameter or less. Several heavy metal solders appear suitable.

In one practical example, the heavy metal alloy for this alternative procedure is composed suitably of 80% gold and 20% tin by weight in composition. The composition of the heavy metal powder is recognized as being a familiar solder alloy. The gold alloy power is placed on the face of the crystal, as represented at 22, and is then swept into the slots formed in the face of the crystal, filling the slots, as represented at 24. Sweeping is suitably accomplished using the same squeegee 23 and squeegeeing process described in the preceding embodiment of FIG. 1. Alternatively, a brush may be used to sweep the metal powder into the slots. A commercially available gold-tin solder flux is then applied to the powder in the slots, suitably by spraying or brushing, represented at block 28.

Some known solder alloys are eutectic, that is, they liquify at a specific temperature, the eutectic temperature. The eutectic temperature of the 80% gold and 20% tin solder is 280 degrees Centigrade. Solder fluxes are materials, such as resins, that clean the surface of materials to be soldered and act as a catalyst causing the liquified solder to flow and fuse or bond to the material being soldered. Here, the flux encourages the solder alloy to flow into the microscopic interstices in the silicon walls of the slots formed in the crystal.

The assembly is then heated to the eutectic temperature of the solder alloy, as represented by block 30 and the powder liquifies and flows. Once the solder alloy flows, the heat is withdrawn as at 32. The assembly cools in the ambient to a temperature below the eutectic temperature of the alloy; and the alloy cools and solidifies. The flux and metal residue as may be present on the surface of the crystal during the flux application is cleaned off the crystal's surface as at 34, suitably using the surface grinding technique described in connection with the first embodiment, and the collimator grid is completed and essentially ready for use. In the event that the slat did not form to the desired height, then the foregoing process of filling the slot, heating the assembly to the eutectic temperature and cooling the assembly may be repeated as necessary until the slot is filled to the desired level.

Effectively, a heavy metal slat is formed in the shape of the slot, and the slot effectively serves as a mold. Further the slat is firmly mechanically attached to the crystal and cannot be removed unless such a great enough force is applied as would damage the crystal.

Another practical embodiment for the foregoing procedure employs a metal alloy of 88% Gold and 12% Germanium (Ge)(by weight), which has a melting point of 356 degrees centigrade, may be substituted for the 80/20 solder alloy. Neither of the last two described alloys is likely to wet the Silicon material and firm a chemical bond to the Silicon. The best that can be expected of those practical embodiments is to form a mechanically locked cast-in slat that will not move. To achieve chemical bonding with the foregoing materials, one must employ intermediate metallization procedures. As example, the walls of the groove may be metallized with a combination of sputtered metals, such as Titanium, Tunsten and Gold. Such metallization is difficult to execute within the deep microscopically narrow Silicon walled slot. Because of that difficulty, chemical bonding is not preferred for those practical embodiments, and the mechanical bonding should suffice.

Another practical embodiment for the latter procedure employs a metal alloy consisting of of 96.4% Gold and 3.6% Silicon (Si) (by weight), which has a melting point of 371 degrees Centigrade, or using Gold alone. When heated to its eutectic temperature, the alloy "wets" the Silicon, enabling formation of a chemical bond between the slat and the Silicon slot walls. Upon cooling, the slat is firmly bonded to the wafer. Althernatively, the Gold Silicon alloy can be formed by melting pure Gold powder against the slotted Silicon wafer and thus will not have any issue in wetting the etched Silicon surface. This is the most direct manner to obtain a strong intimate chemical bond between the slats and the Silicon walled slots. It is expected that this construction forms the strongest slat structure and may be preferred for that reason.

Figure 5:
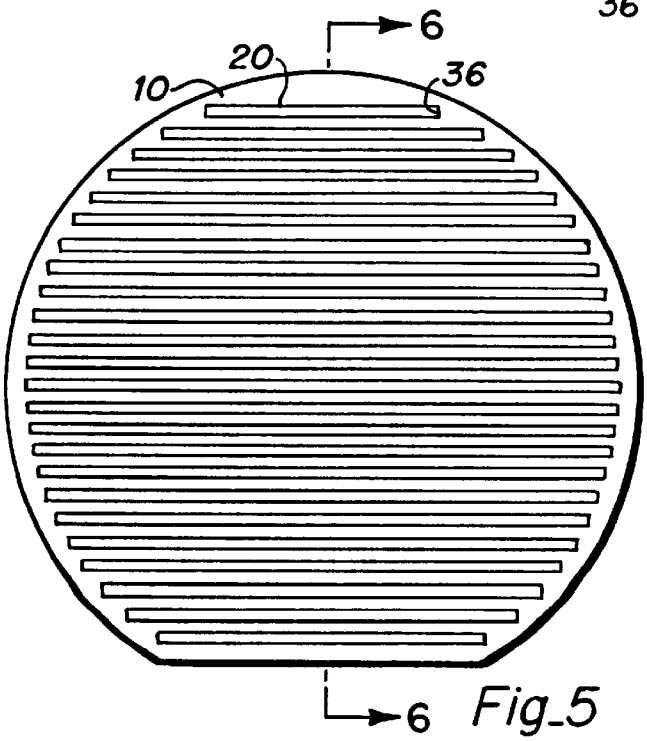
FIG. 5 illustrates an X-ray collimator grid product in front view formed by the described method.
Figure 6:
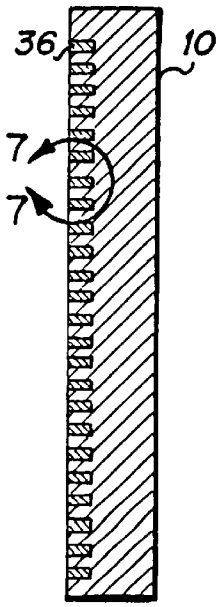
FIG. 6 illustrates the resultant X-ray collimator grid in side section view taken along the lines 6—6 in FIG. 5.

FIG. 5 is a front or top view, not drawn to scale, of an X-ray collimator formed by either of the described processes. FIG. 6 is a side section view of FIG. 5 taken along the lines 6—6 in FIG. 5. And FIG. 7. is an enlarged partial section view taken along the lines 7—7 in FIG. 6. The monocrystalline silicon wafer 10 supports spaced parallel essentially rectangular shaped slats 36, only one of which is labeled, within slots 20. Each slat is of a solid unitary structure, the ingredient materials having been fused together. The pitch, the repetition interval of the slot pattern, is about thirty-four microns, in which the slot width, and therefore the slat width, is about fifteen microns. The depth of each slot, and of the seated slat, is about 1,170 microns. The ratio of the slot depth to the width is at least about 80:1. As those skilled in the art appreciate, other collimator grids incorporating the present invention may be constructed with other values of pitch, in which case, the width and depth of the slot must be recalculated.

Figure 7:
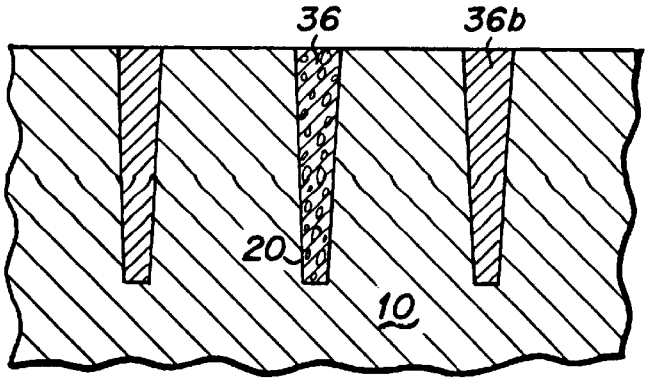
FIG. 7 is a partial side section view taken along the lines 7—7 in FIG. 6, showing the slats formed in situs in the slots.

As illustrated in the enlarged partial section view of FIG. 7, the top and bottom surfaces of the slats engage interstitial areas, fill in any unevenness in the side walls of the slots as a consequence of the liquification and re-solidification of the slat material in situs within the slots. Accordingly, the slats are rigidly affixed within the slot and cannot be easily withdrawn.

For purposes of illustration only, the enlarged cross section view of FIG. 7 is modified to illustrate at least one slat formed by each of the two described processes. Slat 36 is illustrated as composed of metal granules within an epoxy matrix, as was accomplished through the curing process of FIG. 1. And slat 36*b* is illustrated as solid, as being formed by the fusion process of FIG. 4. The foregoing is for illustration only, since the processes are alternative and only one type of slat can be formed in the crystal wafer.

It is believed that the foregoing description of the preferred embodiments of our novel method is sufficient in detail to enable one skilled in the art to practice the method and make and use the collimator grid resulting from the practice of that method. However, it is expressly understood that the detail of the steps and elements presented for the foregoing purpose is not intended to limit the scope of the method, in as much as equivalents to those steps and other modifications thereof, all of which come within the scope of the described method, will become apparent to those skilled in the art upon reading this specification. Thus the method is to be broadly construed within the full scope of the appended claims.

What is claimed is:

1. The process of fabricating an X-ray collimator grid in a silicon crystal wafer that contains a plurality of spaced parallel deep elongate slots of microscopic width depending from an upper surface of said wafer, which includes the steps of:

forming a sold slat of heavy metal in situs with n each of said slots to fill each slot, with each said s conforming to the walls of an associated slot and filling irregularities, whereby at least a frictional bond is created between the slat and the spaced side walls defining g respective slot;

said step of forming a slat including h steps of:

placing particles of heavy metal comprising pure gold on said upper surface; and moving said particles of heavy metal alone said upper surface and into said slots by brushing particles of heavy metal into said slots; and heating said silicon crystal wafer and said particles to the melting temperature of said pure gold to liquefy said particles within said slots and form a gold silicon eutectic alloy that chemically bonds to silicon.

2. The method of forming an ray collimator arid In a silicon crystal wafer, said wafer having planar surfaces taken along the <110> crystal plane, said latter plane being oriented perpendicular to the <111> crystal plane, comprising the steps of:

forming a plurality of spaced deep elongate slots of microscopic within the planar, 110> surface of a silicon crystal, said slots depending from said planar surface to a predetermined depth into said crystal wafer and being oriented parallel to one another and to the <111> plane of said crystal; and forming a solid slat of heavy metal in situs within each of said slots from heavy metal particles to produce a plurality of slats in said wafer filling said elongate slots including the steps of:

depositing heavy metal particles upon the surface of said silicon crystal comprising the steps of:

preparing a metal paste of heavy metal particles and an epoxy binder material, wherein said heavy metal particles are disposed in said paste, and depositing said paste upon the surface of said silicon crystal, said metal particles being of a size small enough to fit within said slots;

moving a squeegee along said surface to force said heavy metal particles within said slots, said slats substantially filling aid respective slots and being at least mechanically linked to said silicon crystal; and following said step of moving a squeegee along said surface, heating said silicon crystal and said epoxy binder material to cure said binder material, whereby said metal paste softens and flows into available space at the lowermost available space within said respective slots to form said rigid slats and link said rigid slats to said silicon crystal.

3. The method as defined in claim 2, further comprising the step, prior to said step of heating said silicon crystal and said epoxy binder material, of degassing said silicon crystal to pull entrained air from said epoxy binder material.

4. The method as defined in claim 2, further comprising the steps, following said step of heating, of:

determining whether said slots are filled, and, only if such determination is negative, repeating said steps of depositing heavy metal particles on said surface of said silicon crystal, squeegeeing said heavy metal particles into said slots, reheating said silicon crystal and said epoxy binder material, and again determining whether said slots are filled, and repeating said last three named steps of depositing, squeegeeing and reheating until said slots are completely filled.

5. An X-ray collimator grid, comprising:

a monocrystalline silicon substrate;

said substrate having top and bottom planar surfaces, and said substrate including a plurality of straight narrow deep slots within a top planar surface and extending perpendicular thereto, said slots including right and left hand side walls;

a plurality of slats, each of said slats containing at least a predominant portion of heavy metal for rendering said slats impenetrable to X-radiation; each of slats consisting of a core of Gold and right and left outer side walls to said core of a Gold Silicon alloy; each of said slats being formed within a respective one of said plurality of slots; said right and left outer side walls of said slats forming a bond to respective right and left hand side walls of said slots for preventing removal of said slats from said slots.

6. The method of forming an X-ray collimator grid in a silicon crystal wafer, said wafer having planar surfaces taken log the <110> crystal plane, said latter plane being oriented perpendicular to the <111> crystal plane, comprising the steps of:

forming a plurality of spaced deep elongate slots of microscopic width within the planar <110> surface of a silicon crystal, said slots depending from said planar surface to a predetermined depth into said crystal wafer and being oriented parallel to one another and to the <111> plane of said crystal; and forming a solid slat of heavy metal in situs within each of said slots from heavy metal particles to produce a plurality of slats in said wafer, said heavy metal particles being an eutectic alloy having a predetermined eutectic temperature and comprising an alloy of Gold and Tin, said heavy metal particles being of a size less than said microscopic width of said slots and said slats filling said respective slots and being at least mechanically linked to said silicon crystal;

said step of forming a slat of heavy metal including the steps of:

depositing said heavy metal particles upon the surface of said silicon crystal;

moving said heavy metal particles along said surface to deposit said heavy metal particles within said slots;

applying a solder flux to said slots over said hi metal particles:

heating said silicon crystal and said heavy metal particles at least to said predetermined eutectic temperature to change the state of said metal particles from a solid state to a liquid state without changing said silicon crystal from a solid state; and terminating said heating to permit said heavy metal particles to change from said liquid state back to said solid state and thereby form said slats.

7. The method as defined in claim 6 wherein said slots are formed of a width in the range of fifteen microns and one-hundred microns and a depth no less than essentially 80 times said width.

8. The method of forming an X-ray collimator grid in a silicon crystal wafer, said wafer having planar surfaces taken along the <110> crystal plane, said latter Plane being oriented perpendicular to the <111> crystal plane, comprising the steps of:

forming a plurality of spaced dee elongate slots of microscopic width within the planar <110> surface of a silicon crystal, said slots depending from said planar surface to a predetermined depth into said crystal wafer and being oriented parallel to one another and to the <111> plane of said crystal; and forming a solid slat of heavy metal in situs within each of said slots from heavy metal particles to produce a plurality of slats in said wafer, said heavy metal particles consisting of an eutectic alloy selected from the group consisting of: (1) a Gold and Germanium alloy in the following composition: 88% Gold and 12% Germanium (by weight); and (b) a Gold and Silicon alloy in the following composition: 96.4% Gold and 3.6% Silicon (by weight), said heavy metal particles being of a size less than said microscopic width of said slots and said slats Filling said respective slots and being at least mechanically linked to said silicon crystal; said step of forming a slat of heavy metal including the steps of depositing said heavy metal particles upon the surface of said silicon crystal and moving said heavy metal particles along said surface to deposit said heavy metal particles within said slots.

9. An X-ray collimator grid, comprising:

a monocystalline silicon substrate;

said substrate having a top and bottom planar surfaces, and said substrate including a plurality of straight narrow slots within a top planar surface extending perpendicular thereto, said slots including right and left hand side walls;

said top and bottom planar surfaces being within <110> crystal plane; and said slots extending parallel with a <111> crystal plane;

a plurality of slats, each of said slats including at least a predominant portion of heavy metal for rendering said slats impenetrable to X-radiation, said heavy metal comprising a eutectic metal alloy selected form the group consisting of (a) Gold and Germanium in the following composition: 88% Gold and 12% Germanium (by weight); (b) Gold and Silicon in the following composition: 96.4% Gold and 3.6% Silicon (by weight); and (c) Gold and Tin in the following composition: 80% Gold and 20% Tin (by weight), each of said slats being disposed within and filing a respective one of said plurality of slots and said slats having side walls intimately engaging said side walls of said slots for inhibiting removal of said slats from said slots.

10. The process of fabricating an X-ray collimator grid in a silicon crystal wafer that contains a plurality of spaced parallel deep elongate slots of microscopic width depending from an upper surface of said wafer, which includes the steps of:

forming a solid slat of heavy metal in situs within each of said slots to fill up each slot, with each said slat conforming to the walls of an associated slot and filling irregularities, whereby at least a frictional bond is created between the slat and the spaced side walls defining a respective slot said step of forming a slat, including the steps of:

placing particles of heavy metal comprising an eutectic metal alloy on said upper surface; and moving said particles of heavy metal along said upper surface and into said slots by brushing particles of heavy metal into said slot and heating said silicon crystal wafer and said particles to the eutectic temperature of said eutectic metal alloy to liquify said particles within said slots.

11. The process defined in claim 10, wherein said eutectic metal alloy consists of a eutectic alloy selected from the group of (a) a gold and germanium alloy, (b) a gold and silicon alloy and (c) a gold and tin alloy.

12. The process defined in claim 10, further comprising the step, prior to said step of heating, of:

applying a solder flux to said slots over said particles.

* * * * *

UNITED STATES PATENT AND TRADEMARK OFFICE

CERTIFICATE OF CORRECTION

PATENT NO. : 6,018,566
DATED : January 25, 2000
INVENTOR(S) : Carol D. Eberhard et al.

It is certified that error appears in the above-identified patent and that said Letters Patent is hereby corrected as shown below:

Column 10,
Line 35, replace “with n” with -- within --.
Line 36, replace “s” with -- slat --.
Line 41, replace “g” with -- a --.
Line 42, replace “h” with -- the --.
Line 53, replace “ray” with -- X-ray --.
Line 53, replace “arid” with -- grid --.
Line 53, replace “In” with -- in --.
Line 59, replace “microscopic” with -- microscopic width --.

Column 11,
Line 11, replace “aid” with -- said --.
Line 56, replace “log” with -- along --.

Column 12,
Line 13, replace “hi” with -- heavy --.
Line 29, replace “Plane” with -- plane --.
Line 32, replace “dee” with -- deep --.
Line 48, replace “Filling” with -- filling --.

Column 13,
Line 2, replace “form” with -- from --.

Signed and Sealed this

Twenty-eighth Day of January, 2003

JAMES E. ROGAN
*Director of the United States Patent and Trademark Office*